US007950874B2

(12) United States Patent
Guntert, Jr. et al.

(10) Patent No.: US 7,950,874 B2
(45) Date of Patent: May 31, 2011

(54) SLIPFORM PAVING MACHINE WITH ADJUSTABLE LENGTH PAVING KIT

(75) Inventors: Ronald M. Guntert, Jr., Stockton, CA (US); Richard W. Francis, Stockton, CA (US)

(73) Assignee: Guntert & Zimmerman Const. Div., Inc., Ripon, CA (US)

( * ) Notice: Subject to any disclaimer, the term of this patent is extended or adjusted under 35 U.S.C. 154(b) by 43 days.

(21) Appl. No.: 12/425,325

(22) Filed: Apr. 16, 2009

(65) Prior Publication Data

US 2010/0266339 A1 Oct. 21, 2010

(51) Int. Cl.
*E01C 19/12* (2006.01)

(52) U.S. Cl. ..... 404/105

(58) Field of Classification Search ..... 404/96, 404/101, 104, 105, 106, 119
See application file for complete search history.

(56) References Cited

U.S. PATENT DOCUMENTS 3,970,405 A * 7/1976 Swisher et al. ..... 404/105
4,379,653 A * 4/1983 Brown ..... 404/118
4,678,365 A * 7/1987 Ban et al. ..... 404/118
5,615,972 A * 4/1997 Guntert et al. ..... 404/72
5,647,688 A * 7/1997 Guntert et al. ..... 404/101
6,390,728 B1 * 5/2002 Casters ..... 404/100
6,471,442 B1 * 10/2002 Deeb et al. ..... 404/96
6,582,152 B2 * 6/2003 Leone et al. ..... 404/75
6,872,028 B2 * 3/2005 Aeschlimann et al. ..... 404/105
7,651,295 B2 * 1/2010 Eppes et al. ..... 404/84.05
2003/0185626 A1 * 10/2003 Aeschlimann et al. ..... 404/105

* cited by examiner

*Primary Examiner* — Robert E Pezzuto
*Assistant Examiner* — Matthew D Troutman
(74) *Attorney, Agent, or Firm* — Kilpatrick Townsend and Stockton LLP

(57) ABSTRACT

A concrete paving machine which has a main frame and two hydraulic jacking columns at each end of the frame for raising and lowering the machine frame. Crawlers attached to the jacking columns move the paving machine in the travel direction. A paving kit is secured to the main frame and has a rigid center portion. Each terminal kit has an end frame secured to the center portion, an adjustable length support structure between the end frame and the slipform, and a hydraulic actuator. Spacers are interposed between the end frame and the slipform. A finishing pan is provided to finish the concrete surface. All replaceable components of the terminal are constructed and arranged so that they can be manually exchanged be one or two persons without removing the paving kit from the main frame and without needing the help of lifting equipment.

23 Claims, 9 Drawing Sheets

SLIPFORM PAVING MACHINE WITH ADJUSTABLE LENGTH PAVING KIT

BACKGROUND OF THE INVENTION

The present invention concerns concrete slipform paving machines that are made up by a propelling unit or tractor from which a paving kit is suspended with which a layer of concrete is shaped and finished as the propelling unit travels along a road or airfield alignment. The paving kit is configured so that its length can be manually varied in the field in an exceedingly short period of time requiring only simple hand tools such as wrenches, pry bars and hammers.

The tractor of concrete slipform paver has a rectilinear frame which straddles the concrete roadway or airfield pavement section that is being paved. The frame is propelled and supported on either end by crawler tracks mounted on side bolsters. These side bolsters each have two hydraulic supporting jacking columns that allow the tractor frame elevation to be manually or automatically varied relative to the ground. The frame, and in particular a center module thereof, supports a diesel engine-driven hydraulic power unit which supplies power to the tractor and the paving kit.

The paving kit is conventionally suspended below the tractor frame by mechanical means, such as with hooks and a locking mechanism. The paving kit takes its hydraulic power from the power unit on the tractor. The tractor and the paving kit pass over the fresh concrete placed in and distributed over its path as a relatively even and level mass that can be conveniently slip-paved. During this process, the tractor-attached paving kit spreads the semi-solid concrete dumped in the path of the paver, levels and vibrates it into a semi-liquid state, then confines and finishes the concrete back into a semi-solid slab with an upwardly exposed and finished surface. The sideforms mounted on the side of the slipform kit shape and confine the sides of the slab during the slipform paving process.

The tractor has four crawler tracks supporting and propelling the frame with the attached paving kit. Other kits can be attached to these tractors such as kits for conveying and spreading concrete and trimming and spreading base materials. For the purposes of this description, the focus is on the paving kit used for concrete slipform paving and the tractor frame carrying it.

The length of the tractor frame in a transverse direction that is normal to the direction of the paving movement is adjustable to span different widths of pavements within the limits of the frame's telescopic extensions. Once these telescopic extensions limits are reached, a fixed frame extension can be added to one or both sides of the telescopic frame for further extension. Within the telescopic ability of the tractor frame, the process of changing the tractor frame width is a relatively simple and not a very time-consuming operation. Adding one or more fixed frame extensions significantly increases the complexity and difficulty of changing the width of the tractor frame.

When the width of the concrete strip that is being laid down must be adjusted, that is, either widened or narrowed, e.g. is different from the width last laid down by the paver, it is necessary to correspondingly adjust the length (in a lateral direction relative to the paving machine movement) of the paving kit. In the past, this was a major task that required heavy equipment, such as a crane, a partial disassembly of the paving machine, and tedious work to put it all together before the machine becomes operable again.

This is principally due to the construction of paving kits. These paving kits have a center portion, typically a truss assembled from several self-contained truss sections each having a length of between two to four feet, which are bolted together. A terminal section which includes a terminal truss section and a sideform, (the sideform which forms the outermost sides of the concrete that is being vibrated and laid down) is attached to the respective outermost sections of the center portion of the truss. When it becomes necessary to change the width of the machine, the operator must position the machine on a level surface, and he then lowers the paving kit to the ground onto prepositioned supports, for example 12×12 wooden timbers, by lowering the machine with the supporting jacks until the paving kit comes to rest on the support blocks. The paving kit is then disconnected from the tractor frame, which is moved away so that the paving kit becomes accessible from above.

Thereafter a workman identifies and disconnects the paving kit truss section(s) to be removed, lifts them out of the paving kit with a crane or other lifting device due to their weight, sets the just-removed frame sections to the side, picks up a truss section of the desired length, aligns it with the end of the remaining paving kit truss section, and bolts all paving kit parts back together. Thereafter, the tractor frame is moved back over the paving kit, the latter is connected to the former (typically with a hook connection, as is well known in the art), and the tractor frame is raised to lift the paving kit attached to it off the ground. This is a task that typically takes between eight to twelve hours, requires at least two persons, involves costly equipment, requires hydraulic lines and electrical cords to be disconnected and then reconnected, and unproductively idles the machine during the width change process, all of which is undesirable because it increases costs and reduces the time available for actually paving.

BRIEF SUMMARY OF THE INVENTION

It is a principal object of the present invention to streamline and speed up changing the width of the paving kit from one dimension to another for sequentially laying concrete strips of correspondingly different widths.

While in the past such a change of the paving kit width required the disassembly of the paving kit and the main machine frame and lifting equipment such as cranes for lifting the heavy components, a paving kit constructed in accordance with the invention makes it possible for only one or two persons to manually change the length of the paving kit without removing it from the tractor frame and with hand tools only. In particular, a terminal kit defining the ends of the paving kit is fitted with hydraulic actuators for varying the length of the terminal kit over a preset distance, which in a presently preferred embodiment is about three feet (or one meter) but can be longer or shorter if desired. Telescoping support tubes operatively coupled to the hydraulic actuators are configured to hold variable numbers of relatively lightweight, manually manipulatable, spacer assemblies between the two ends of the terminal kit for setting desired terminal kit lengths. When the required number of spacers is in place, the hydraulic actuators are activated to pull the ends of the terminal kit and the spacer(s) between them against each other, thereby forming a rigid terminal kit the length of which is readily changeable by one person in as little as 30 minutes or less.

Thus, a paving machine that is constructed in accordance with the present invention moves in a travel direction for spreading, leveling and finishing concrete into a form having a generally upwardly exposed, finished concrete surface and terminating in lateral sides. The paving machine has a main frame with first and second bolsters arranged at opposite ends of the frame, each bolster equipped with two supporting jacking columns and crawlers mounted to the bottom of the supporting columns on the end bolsters that move the paving machine along the ground.

A paving kit is secured to, e.g. suspended from, the machine tractor frame, has a substantially rigid center portion that extends in a lateral direction substantially perpendicular to the travel direction, terminates in lateral ends, and is disposed between the bolsters. A variable length terminal paving kit extends from each lateral end of the center portion.

Each terminal (paving) kit is defined by an end frame secured to the center portion of the paving kit frame, a sideform at the lateral end of the terminal kit, and an adjustable length support structure between the end frame and the sideform. The support structure includes hydraulic actuators having operative ends connected to the end form and the sideform, respectively, for moving the end frame and the sideform towards and away from each other. Cooperating pairs of spacers are interposed between the end frame and the sideform, and their combined width defines a portion of the spacing between the end frame and the sideform and therewith of the distance between the lateral sides of the concrete. Slipform finishing pans (of corresponding width to the pairs of spacers) are added underneath the opposing pairs of spacers for finishing the concrete surface, and the hydraulic actuators operatively coupled to the end frame and the sideform apply a compressive force to the spacers and the finishing pans to thereby rigidly connect the end frame to the sideform with the pairs of spacers and the finishing pans underneath them.

The paving kit includes an additional plurality of spacers of differing widths (from fraction of inches to feet) for changing the distance between the lateral sides of the concrete that is being laid down. To change width, the pressure applied by the hydraulic actuators against the spacers and the finishing pans underneath the end frame and the sideform is relieved, spacers and finishing pans of the required widths are substituted for the ones previously disposed between the end frame and the slipform, and thereafter pressure against the substituted spacers and finishing pans between the end frame and the sideform is reapplied with the hydraulic actuators.

The paving kit of the present invention further includes a metering gate located forward of the paving kit for striking off the freshly supplied concrete and for assistance in maintaining a desirable constant head height over the poker vibrators, a vibrator arrangement between the metering gate and the paving kit for vibrating and temporarily liquefying the supplied concrete prior to finishing it, and a trailing finishing pan located on an aft side of the paving machine for further finishing the upwardly exposed concrete surface adjacent the lateral sides of the concrete. The components of these subsystems of the paving machine, which require adjustments when the lengths of the terminal kits are changed, are, like the components of the terminal kit, configured and arranged so that they too can be changed by a single person using only simple hand tools and without requiring a disassembly of the paving kit and/or lifting equipment for handling heavy components.

DETAILED DESCRIPTION OF THE INVENTION

Figure 1:
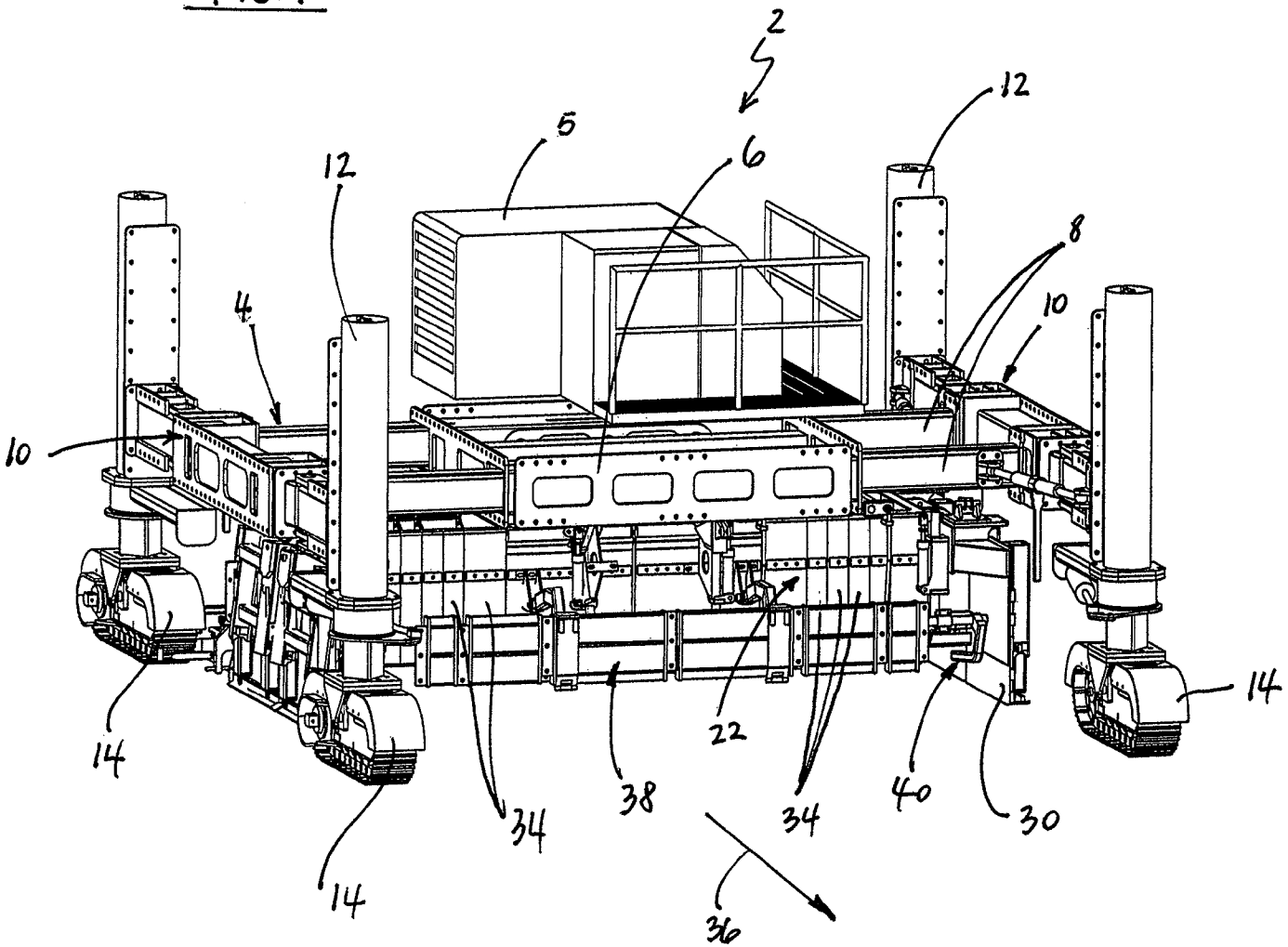
FIG. 1 is a front elevational, perspective view of a paving machine having a paving kit constructed in accordance with the present invention.
Figures 2, 3:
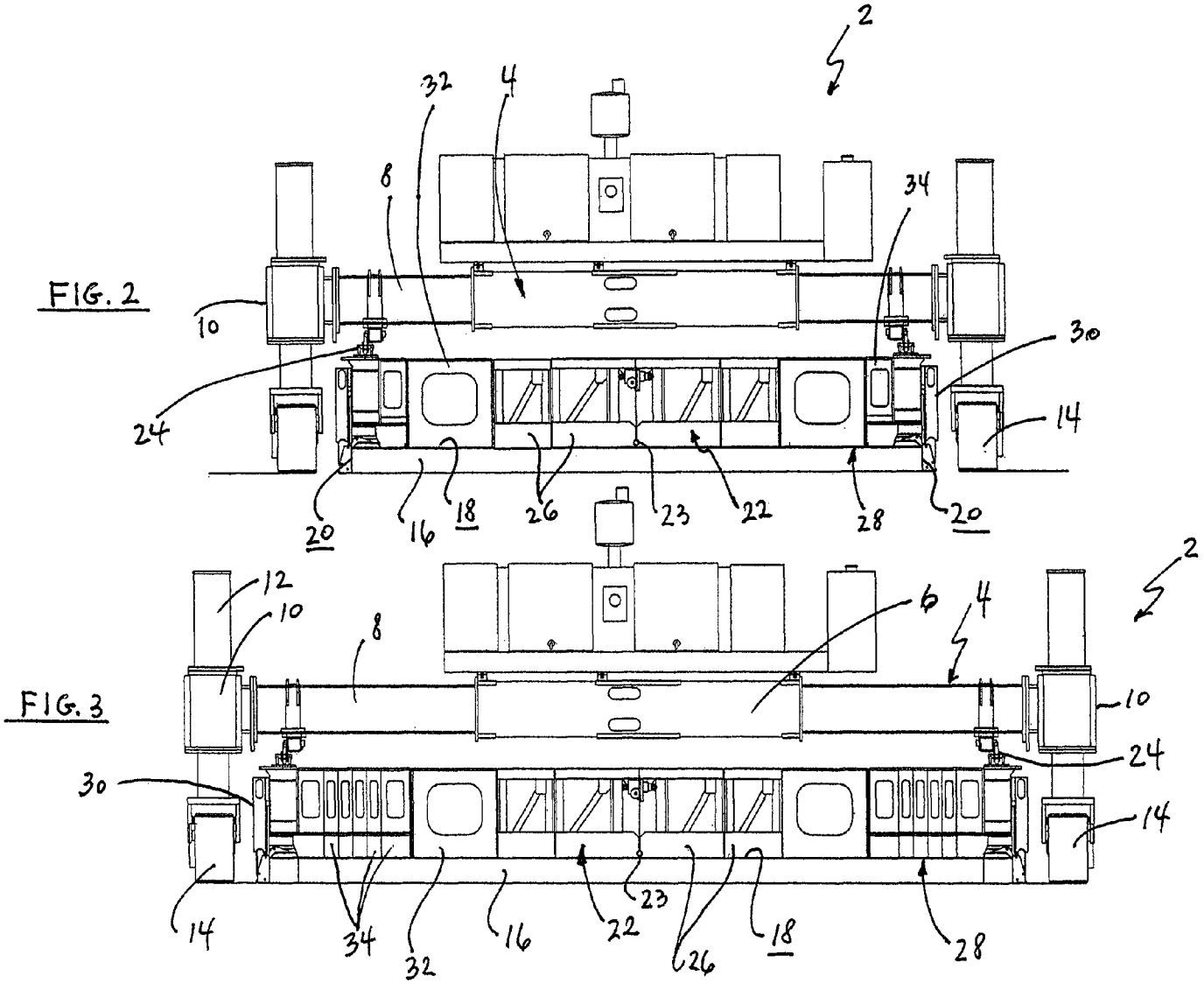
FIG. 2 is a schematic, front elevational view of a paving machine having a relatively short paving kit.
FIG. 3 is a front elevational view of a paving machine having a relatively long paving kit.

Referring initially to FIGS. 1-3, a slipform paving machine 2 has a main tractor frame 4 defined by a central module or platform 6 that carries the diesel engine powered power unit 5 of the paving machine and from which telescoping support beams 8 extend outwardly in a lateral direction. Bolsters 10 are secured to the respective outboard ends of the support beams. Upright jacking columns 12 are mounted at front and aft ends of the bolsters, and crawlers 14 are conventionally secured to the lower ends of the jacking columns. The jacking columns enable the raising and lowering of the paving machine. The crawlers are mounted and rotatable relative to the lower ends of the jacking columns. They support the entire machine and move it over the ground.

In use, the respective bolsters are moved in the lateral direction so that the machine frame, including the crawlers, extends over and clears a strip of concrete 16 being laid by the machine. When finished, the strip of concrete defines an upwardly exposed, appropriately leveled and finished concrete surface 18 that extends across the strip between upright concrete strip sides 20.

A paving kit 22 depends downwardly from main tractor frame 4 and is conventionally secured thereto, for example with a hook connection 24. As is best seen in FIGS. 2 and 3, the mid-portion of paving kit 22 has several, e.g. four, truss sections 26 which are conventionally bolted to each other. The lateral outboard ends of the paving kit are formed by terminal kits 28 constructed in accordance with the present invention and attached to the mid-portion as described below.

Each terminal kit has an end frame 32 that is secured to the outermost truss section 26 of the mid-portion, a guillotine sideform 30 that, in operation, forms concrete slab sides 20, and a plurality of spacers 34 between the end frame and the sideform. The number and sizes of the spacers are selected in accordance with the present invention to provide the paving kit with the desired width to assure an accurate, desired spacing between sideforms and thereby between concrete slab sides 20 that are being formed.

As is further described in greater detail below, hydraulic actuators (not shown in FIGS. 1-3) force sideform 30 against the end frame 32 and thereby compress the spacer pairs 34, the sideform and the end frame firmly against each other to form a terminal kit that is a rigid unit.

As is best seen in FIG. 1, forward of paving kit 22 in the travel direction of the paving machine (indicated by arrow 36) is a wet concrete metering gate 38, and between the metering gate and the paving kit 22 is a vibrator rack 40 which has a multitude of vibrators (not shown in FIG. 1) that extend into the fresh concrete to vibrate and liquefy it, as is well known in the art, prior to finishing its surface. Details of the metering gate and the vibrator rack that affect the present invention are further described below.

In use, the paving machine is aligned with the travel direction 36 so that the concrete strip can be laid between the crawlers 14 of the machine over a width determined by paving kit 22 suspended from the main tractor frame. Fresh concrete is deposited in front of the machine, a spreader plow (not shown) approximately levels the concrete over a major portion of the width of the concrete strip, and, as the machine advances forwardly, metering gate 38 substantially evenly spreads the top of the fresh concrete. Following the "liquification" of the concrete by the vibrators supported by a vibrator rack at a fixed elevation, finishing pans (not separately shown in FIGS. 1-3) on the underside of paving kit 22 finish the top surface 18 of the concrete as the paving kit passes over it, while sideform(s) 30 forms the sides of the concrete strip/slab. A finished concrete strip emerges from the aft end of the paving machine and is permitted to conventionally set and harden.

Following the completion of the concrete strip, the paving machine is typically diverted to a new site for laying another strip of concrete. When the width of the next concrete strip differs from the width of the strip that was just laid by the machine, it is necessary to change, e.g. lengthen, the span of the machine and the paving kit (in a lateral direction perpendicular to the travel direction 36) by correspondingly lengthening (or shortening) the terminal kit 28 of the paving kit, as is described in the following, and lengthening correspondingly (or shortening) the machine frame.

Figures 4, 4A:
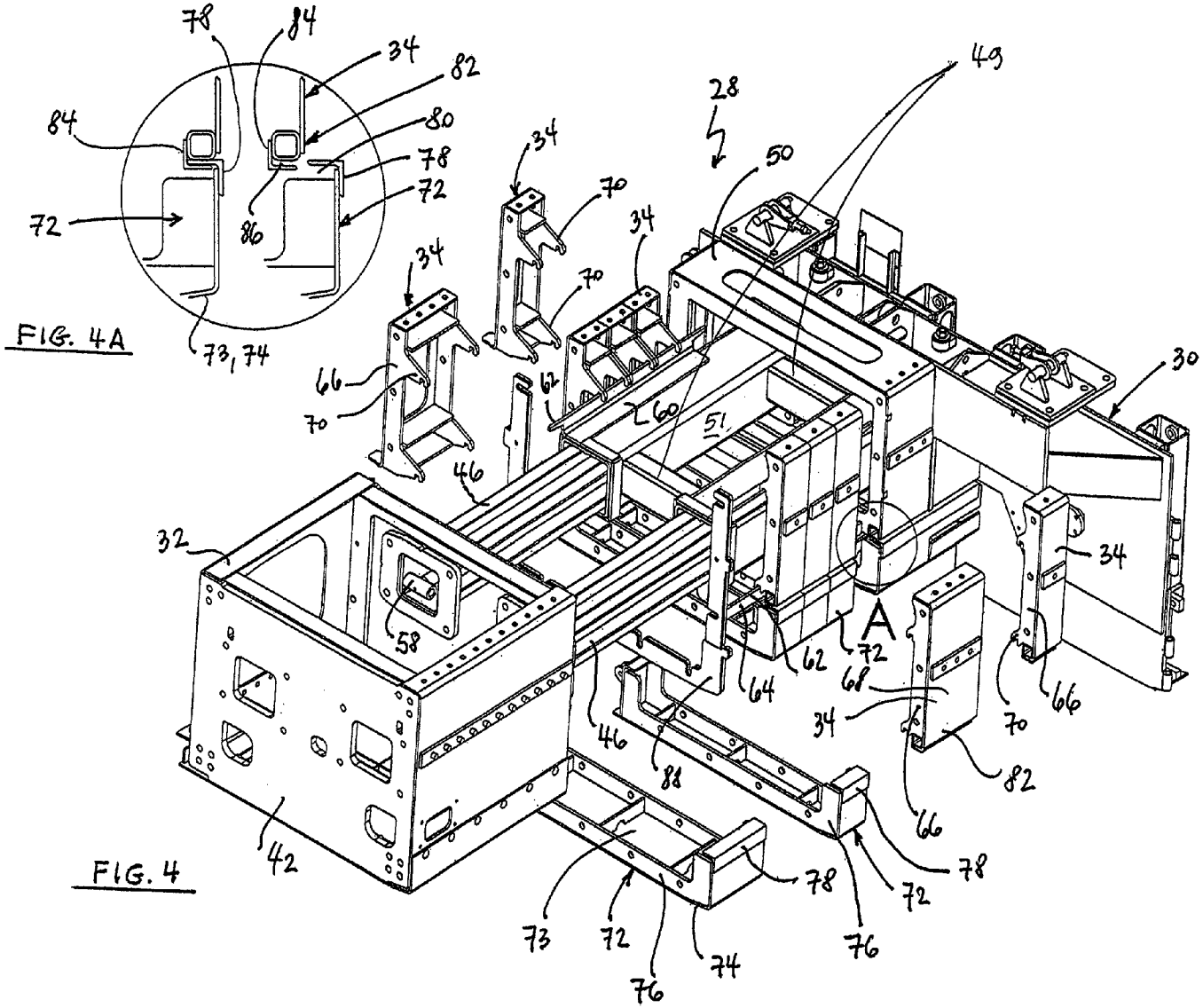
FIG. 4 is a perspective, partially exploded, side elevational view of a terminal kit constructed in accordance with the present invention used on the paving kit shown in FIGS. 1-3.
FIG. 4A is an enlarged detail of the circular portion of FIG. 4 marked "A"
Figure 5:
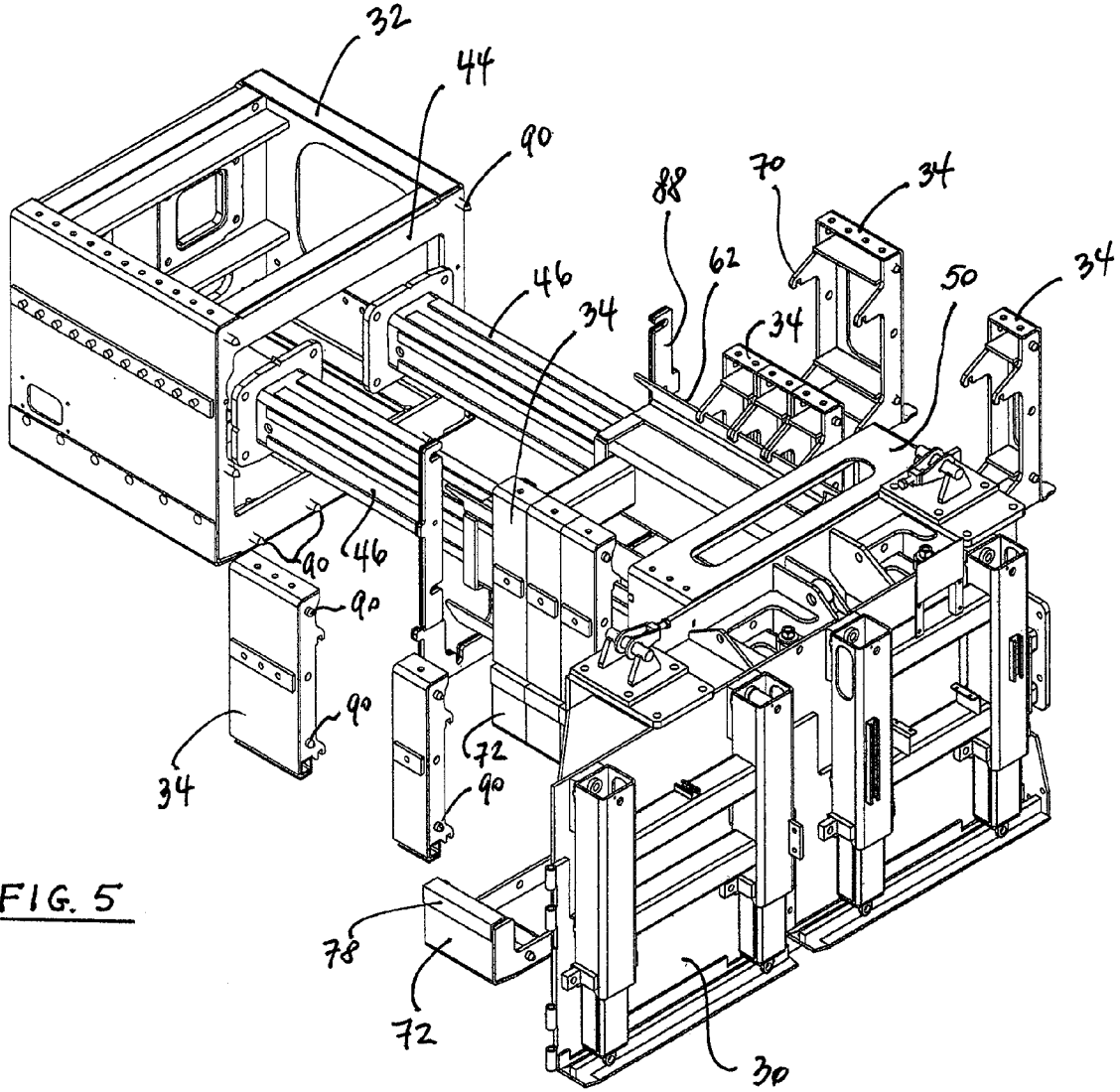
FIG. 5 is a right side elevational, partially exploded view of the terminal kit shown in FIG. 4.
Figures 6, 7:
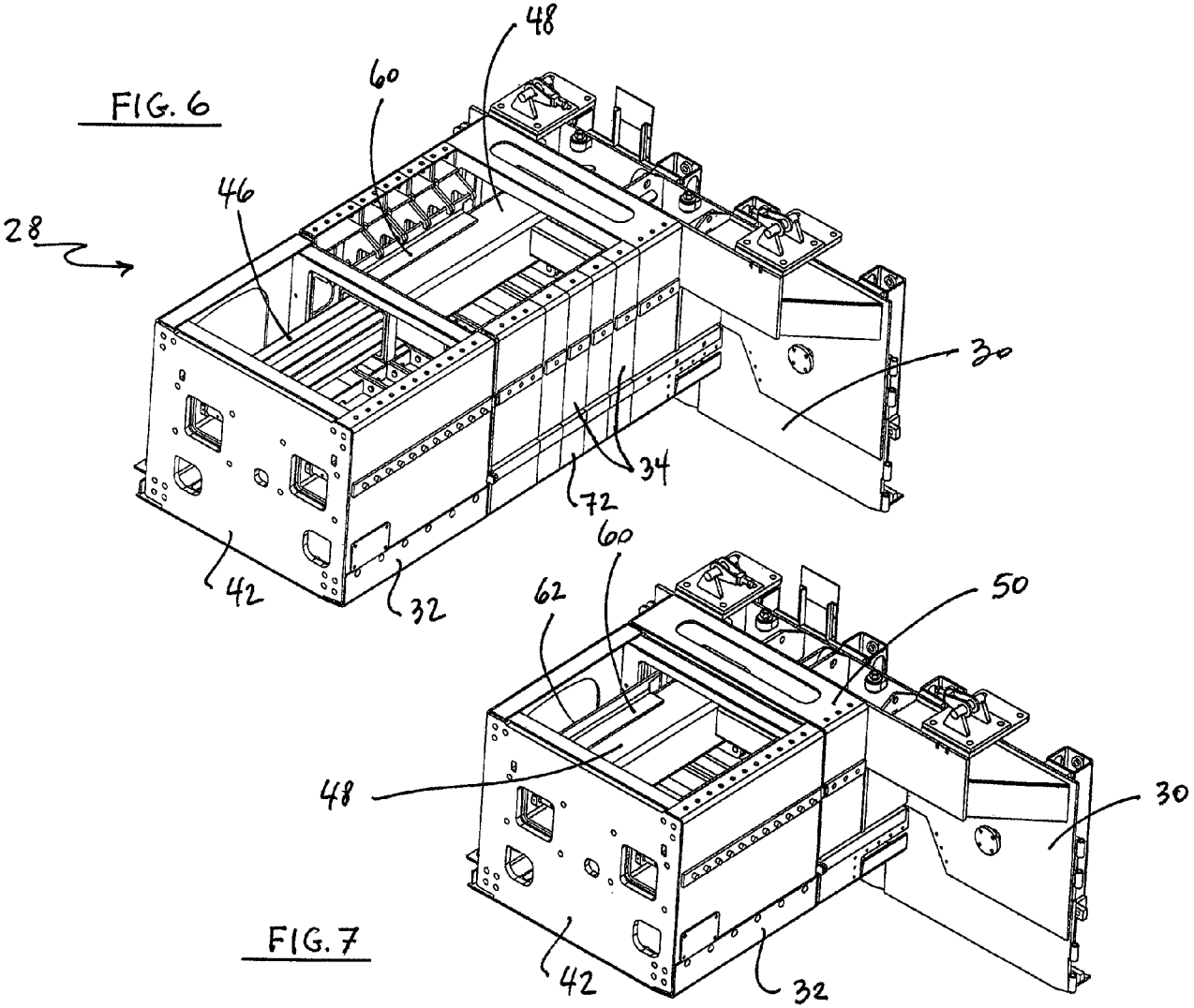
FIG. 6 is a side elevational view of the fully assembled terminal kit shown in FIGS. 4 and 5.
FIG. 7 is a side elevational view of a terminal kit similar to FIG. 6 and shows the terminal kit in its shortest configuration.

Referring to FIGS. 4-6, a terminal kit 28 constructed in accordance with the present invention has the ability to change the distance between end frame 32 and sideform 30 by varying the width (in the lateral direction) and/or number of spacers 34 arranged between them.

The end frame 30 is a box-like structure with an inboard face plate 42 that, in use, is connected to the outermost truss section (not shown in FIGS. 4-6) of the paving kit. The end frame is further bounded by sides, a bottom and an open end surface 44 facing in the lateral direction towards sideform 30. A pair of horizontally spaced-apart hollow male support tubes 46 are secured to the face plate 42 of the end frame with flanges 48 on the tubes. The flanges 48 and face plate 42 are made of relatively thick (e.g. about one inch) metal (e.g. steel) plate to form a rigid base for the male tubes. The male tubes 46 extend laterally past open end 44 of end frame 32 and into associated, hollow female tubes 48 that are aligned with the male tubes. The opposite ends of the female tubes also have flanges at their lateral ends (not separately shown in the drawings) which are secured to an equally strong and rigid box-shaped end member 50 of the terminal kit that functions as a rigid base for the female tubes. Sideform 30 is attached to the outside of the end member. In addition, tubular braces 49 extend between and are securely attached, e.g. welded, to the opposing sides 51 of the female tubes as seen in FIG. 4. The end member 50, the two spaced-apart female tubes 48 and the cross braces 49 form a strong, rigid structure that maintains the tubes aligned and prevents undesirable motions or deflections during use.

Figure 11:
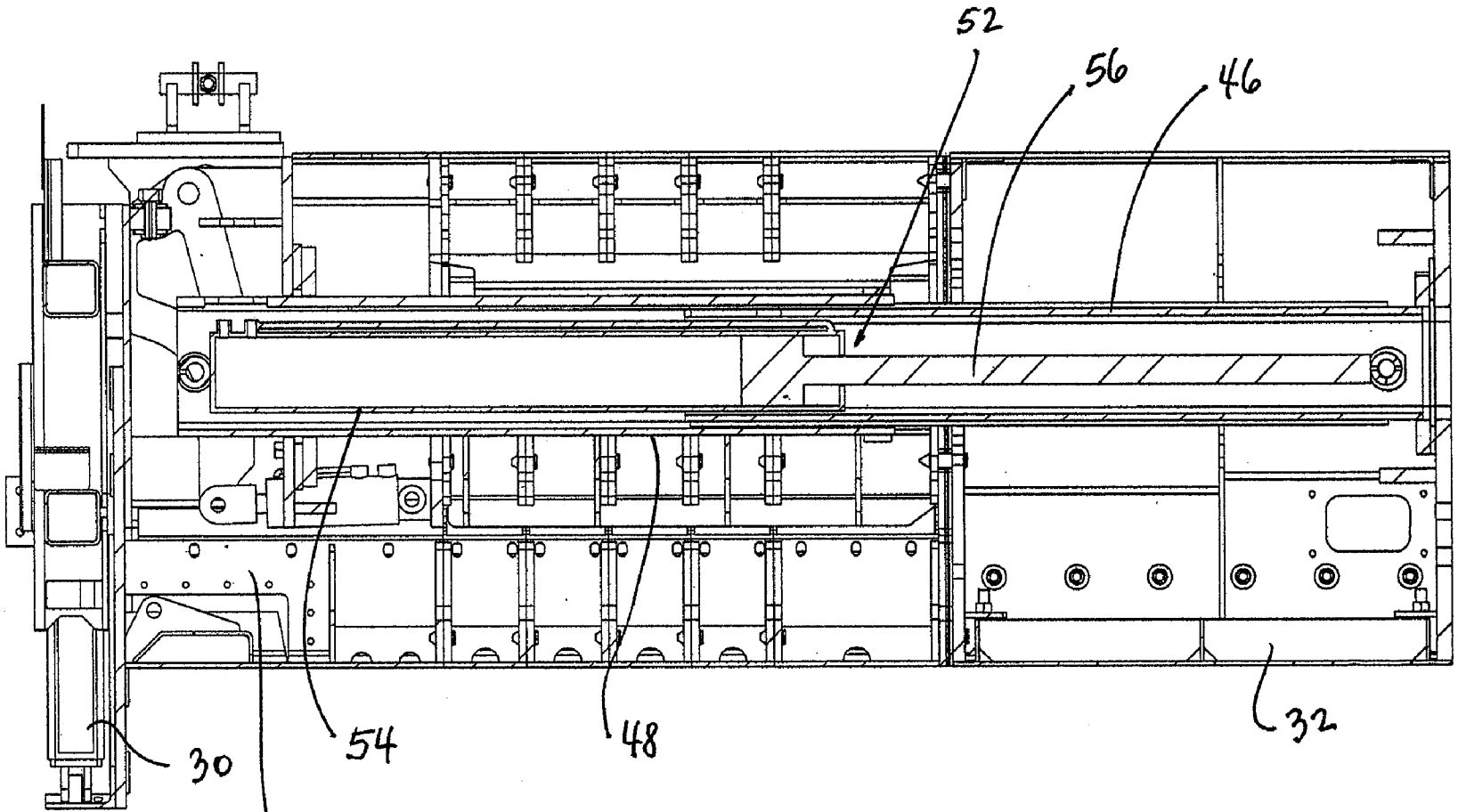
FIG. 11 is a schematic side elevational view through the terminal kit of the paving kit and illustrates the arrangement of the hydraulic actuator for extending and retracting the tubular supports of the terminal kit.

Inside each set of hollow male and female support tubes 46, 48 is a hydraulic actuator 52 having a cylinder 54 and a piston rod assembly 56 (best seen in FIG. 11). An end 58 of piston rod assembly 56 is suitably secured to the end of male tube 46 such as, for example, by a pin that is secured to the male tube and which engages a matching bushing at the end of the piston rod as schematically illustrated in FIG. 4, although other well-known arrangements for securing the ends of piston rods can be substituted if desired. The end of cylinder 54 of the hydraulic actuator is similarly secured to the associated female tube 48. The hollow male tube 46 requires sufficient length inside the female tube when the tubes are in their extended positions to provide sufficient structural engagement between the two to minimize relative lateral movements between them without impairing their ability to slide in their longitudinal directions.

In its fully retracted state when the paving kit 22 has its minimum length (as shown in FIG. 7), the hydraulic actuator is activated to fully retract the piston rod 56 into cylinder 54. In this arrangement, the inboard side of box-shaped end member 50 abuts open end surface 44 of end frame 32 as illustrated in FIG. 7. In a typical embodiment of the present invention, the distance between sideform 30 and face plate 42 of end frame 32 (which abuts the outermost truss section 26 of the paving kit) is approximately five feet (or 1.5 m). When it is desired to lay a wider strip of concrete, sideform 30 must be moved laterally further away from end form 32. For this the hydraulic actuator 52 is activated to move box-shaped end member 50 and sideform 30 attached thereto laterally outwardly. This creates an open space between the end form 32 and the box-shaped end member 50 for receiving one or more spacers 34. The number and width of the spacers are selected so that, when the hydraulic actuator is retracted to compress the spacers between the end frame and the end plate, the lateral distance between sideform 30 from the inboard surface of face plate 42 is as desired.

An angle structure 60 defines a free, generally upwardly oriented upper ledge 62 that is suitably attached, e.g. welded or bolted, to the forward, upper corner of the female tube on the front side of the paver (facing in travel direction 36), and another such angle defining an upper second ledge 62 is applied to the upper, aft corner of the female tube 48 on the aft side of the terminal kit. Lower, upwardly oriented ledges 62 are formed by spaced-apart angle structures 64 which extend from box-shaped end member 50 in an inboard direction. The upper and lower sets of ledges are in substantial vertical alignment with each other. When the hydraulic piston is fully collapsed and the terminal kit has its shortest configuration as shown in FIG. 7, the angles 60, the railings 64 and ledges 62 extend into the hollow interior of end frame 32.

Each spacer 34 has an upright frame 66, the vertical outside of which is covered by a sheet metal layer 68. The frame includes upper and lower hooks 70 close to each end of the spacer which can be dropped onto the upwardly oriented upper and lower ledges 62 on the proximate female tube 48. The weight of the spacers keeps the hooks engaged by the ledges.

An identical spacer 34 is hung over the upwardly oriented ledges 62 on the opposite female tube 48 so that the two spacers define a pair of cooperating, aligned spacers.

A finishing pan 72 is attached to the lower ends of aligned pairs of opposing spacers 34. The finishing pan has a frame 76 and a smooth bottom surface defined by a sheet metal 73 that preferably is slightly upwardly inclined (in the travel direction 36) adjacent its forward end 74 and is suitably secured, e.g. welded, to a pan frame 76 as can be seen in FIG. 4.

As best seen in FIG. 4A, an angle 78 is secured, e.g. welded, onto the upper front end of finishing pan 72 to form a gap 80 between the angle and frame 76 of the finishing pan.

A lower end 82 of each spacer 34 carries another angle 84 which defines another, relatively narrower gap 86 arranged so that the horizontal leg of angle 78 can be slipped into gap 86 on spacer 34. This connects the finishing pan to the lower end of the front spacer where access is limited in a simple manner without the need for fasteners, tools or hoisting equipment. The left-hand side of FIG. 4A shows the lower end 82 of spacer 34 engaging angle 78 of the finishing pan to secure the two parts to each other while the right-hand side shows the spacer and the finishing pan disengaged.

FIG. 4 shows three sets of spacer pairs 34 connected to the associated finishing pans 72 as just described. FIG. 4 also shows two sets of opposing spacer pairs and associated finishing pans in exploded view, the relatively wider spacers being associated with the relatively wider finishing pan, and the relatively narrower spacers being associated with the relatively narrower finishing pan shown in the drawing.

To enable a rapid replacement of spacers (including associated finishing pans) for varying the width of terminal kit 28, each paving machine is provided with a multitude of spacers of varying width (in the lateral direction) in pre-selected intervals of, for example, three inches. Thus, each terminal kit may have one or two sets of spacers and associated finishing pans of a width of 24 inches and several sets of spacers and associated finishing pans of widths of 18 inches, 12 inches, six inches and three inches, for example, although other dimensions can of course be selected to suit a given need.

When it is desired, for example, to establish a width of 21 inches between the opposing surfaces of end frame 32 and box-shaped end member 50, an end plate having a width of 18 inches and another one of a width of three inches, or a set of spacers having widths of 12 inches, six inches and three inches, can be placed between the end frame and the box-shaped end member by first moving the end member away from the end frame to readily accommodate the selected sets of spacers therein. Associated sets of spacers 34 are next hung onto the upwardly oriented ledges 62 on the front and aft sides of the female tubes 48 and the lower railings 64. Once hung, finishing pans 72 are attached to lower ends 82 of the spacers by engaging angles 78 and 86 in the above-described manner. After all sets of spacers and finishing pans are assembled, the hydraulic actuators are activated to retract the male and female tubes until the force generated by the hydraulic actuators firmly pulls the spacers and the finishing pans against each other and against the opposing surfaces of the end frame 32 and the box-shaped end member 50. This forms a rigid, immovable terminal kit that has been lengthened to the desired width, e.g. the above-mentioned 21 inches.

Figure 12B:
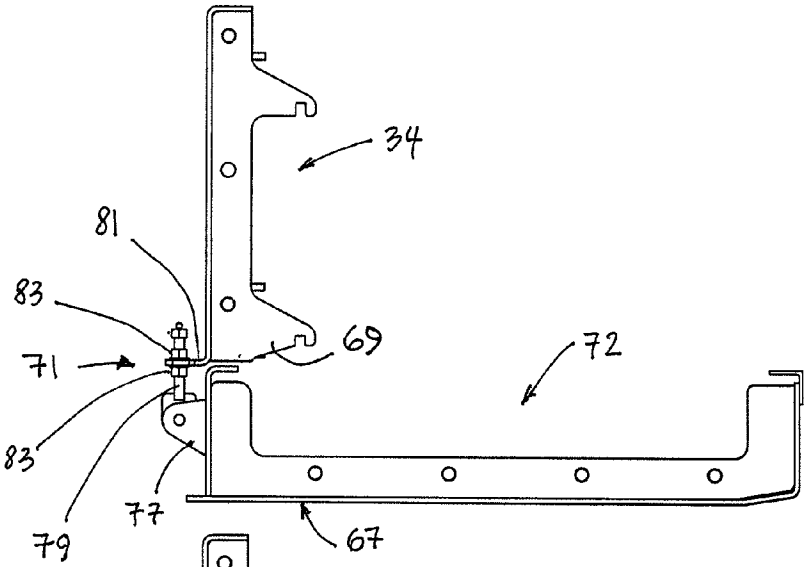
FIGS. 12A, B show a mechanism for aligning the finishing surfaces of finishing pans on the terminal kit.
Figure 12A:
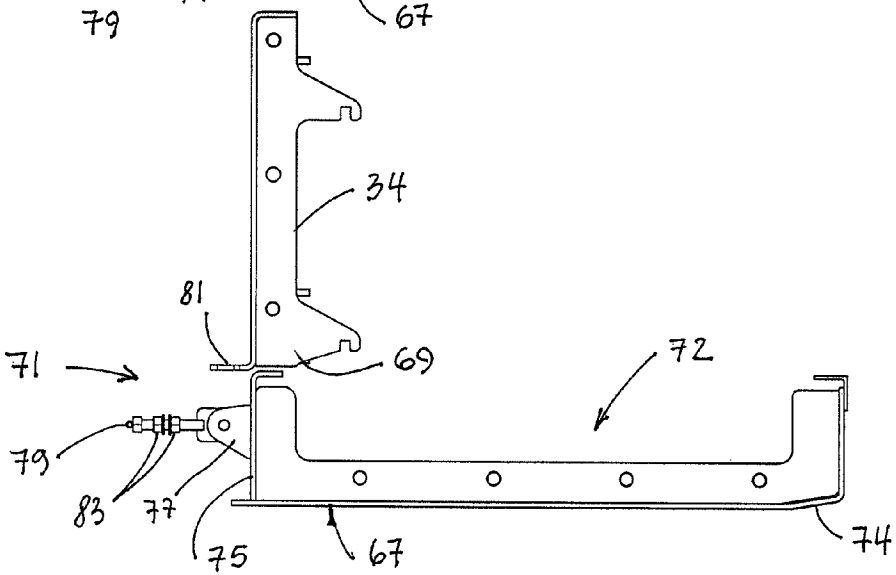

Referring briefly to FIGS. 12A, B, it is of great importance that the underside or finishing surface of finishing pans 72, and in particular the portion of the finishing surfaces of the pans at their aft ends, be accurately aligned to avoid blemishes and irregularities in the concrete surface 18 being paved, because due to machining tolerances and other factors such alignment is difficult to obtain unless the surfaces can be adjusted relative to each other. It is therefore preferred to attach an adjustment mechanism 71 to aft end 75 of the finishing pan 72 and the lower end 77 that permits vertical adjustments of the aft end portion of the finishing pans. In one embodiment of the invention, the adjustment mechanism 71 includes a pair of vertically oriented flanges 77 that pivotally mount a threaded bolt 79 which can be pivoted between a disengaged position (shown in FIG. 12A) and an engaged, upright position (shown in FIG. 12B). When in the upright position, the threaded shaft engages a slot in a horizontal extension 81 projecting in a rearward direction from the lower end 69 of the associated spacer 34. A pair of opposing nuts 83 clamps the horizontal extension to bolt 79 by engaging the horizontal extension between the nuts as seen in FIG. 12B. Following the installation of replacement spacers and finishing pans on the terminal kit, at least the aft portions of the finishing surfaces of the adjacent finishing pans can be brought in precise alignment by adjusting the positions of nuts 83 until all finishing surfaces are aligned.

An important advantage attained with this construction of the terminal kit in accordance with the present invention is that the individual parts of the terminal kit that have to be removed or installed between the opposing surfaces of end frame 32 and box-shaped end member 50 are separate components which can be separately removed by disengaging the finishing pans from the spacers and manually lifting the latter off the supporting ledges in the above-described manner. This is possible because each spacer and finishing pan is of relatively light weight, typically no more than about 50 pounds for spacers having a width of two feet, which are readily lifted and handled by one, and at most two, persons without needing the assistance of cranes, lifters or the like.

Moreover, these components of the terminal kit can be replaced without having to disconnect paving kit 22 from the main machine frame 4 because only little vertical clearance is needed for the removal and replacement of the components. Thus, when it is desired, for example, to lengthen the paving kit for laying a relatively wider strip of concrete, the bolsters 10 mounted at the ends of support beams 8 are moved outwardly by correspondingly lengthening or otherwise extending the beams and, thereafter, moving box-shaped end member 50 of terminal kit 28 laterally outwardly relative to end frame 32 to accommodate the number of spacer 34 and finishing pan 72 combinations required for the desired width of the concrete strip. At this point the installed spacers can be removed by moving them forwardly or rearwardly and slightly upwardly away from the supporting ledges 62 while the finishing pans can be dropped downwardly. The fresh sets of spacer/finishing pan combinations are installed on the ledges by reversing this procedure and, thereafter, hydraulic actuators 52 are activated to forcefully move the box-shaped end member 50 towards end frame 32 until the spacer/finishing pan combinations, properly aligned by alignment pins 90 discussed below, are firmly compressed, which finishes assembling the rigid, extended length terminal kit.

The required movement of bolsters 10 outwardly or inwardly as needed for changing the length of the terminal kit can be accomplished, for example, by rotating crawlers 14 about upright jacking columns 12 so that the crawlers are oriented perpendicular to the travel direction 36. Once in that position, the crawlers can be activated to move the support beams 8 of the tractor frame 4 inwardly or outwardly as needed. In addition, the tractor frame is raised with the jacking columns to provide access to terminal kit 28 for removing and/or installing spacers 34 and finishing pans 72. Following the installation of the spacers and the finishing plates, the crawlers are rotated back so that they extend in the travel direction, and the jacking column is activated to lower tractor frame 4 and therewith paving kit 22 to the desired elevation.

Alternatively, as is well known, access to terminal kits 28 for replacing spacers 34 and finishing pans 72 can be accomplished by initially raising the tractor frame relative to the ground to prop up the tractor frame sufficiently so that supports (not shown) can be placed beneath the center platform 6. The crawlers are then further raised sufficiently to lessen their weight on the ground, or to lift the crawlers completely off the ground, so that thereafter the support beams 8 of the machine frame can be used to move bolsters 10 outwardly or inwardly, as needed, for lengthening or shortening the terminal kit. After the terminal kit has the desired length, jacking columns 12 are activated to lower crawlers 10 until they bear the full weight of the machine and the supports beneath the center platform 6 can be removed from under the frame. Thereafter the tractor frame is lowered until the paving kit, with the now-changed length of terminal kits, is at the desired elevation.

The task of exchanging spacers and finishing pan combinations can therefore be manually performed with only simple hand tools and without requiring a disassembly of the paving machine, a removal of the paving kit from the main machine frame, and/or the assistance of cranes or other heavy equipment as was necessary in the past. This entire changeover can be performed by two persons in as little time as about 30 minutes, whereas in the past changing the width of the paving kit typically required between one or two days of work by a crew of three or more persons, heavy tools and a crane during which the machine was necessarily idle.

At times it is necessary to make fine-length adjustments on the terminal kit to accommodate variations in the concrete mix, in atmospheric conditions and the like so that the finished concrete strip ultimately has a width as close to the specified width as possible to prevent concrete width overruns, not waste concrete and the like. For this purpose, a generally U-shaped spacer shim 88 with opposing, aligned upright sections and an interconnecting, horizontal portion functions as a finishing pan over the thickness of the shim to lengthen the terminal kit by fractions of an inch and more. A plurality of spacer shims of differing widths, such as one-quarter inch, one-half inch, three-quarter inch, etc., can be provided to accommodate different width adjustment needs.

To make such a width adjustment, a spacer shim is inserted between the open end 44 of end frame 32 and the next spacer/finishing pan 34, 72 combination. The spacer shim too is compressed between a spacer and the end frame 32 to become part of the rigid terminal kit when the hydraulic actuator presses the box-shaped end member 50 via the intervening spacers against the open end 44 of the end frame 32.

To maintain precise alignment of the finishing pans 72, as well as corresponding finishing pans on the end frame 32 and the box-shaped end member 50, the mating surfaces of the end frame, spacers 34, finishing pans 72 and end member 50 are provided with alignment pins 90 that engage corresponding holes on the surfaces of the opposing members. This ensures that the paving kit has a smooth and continuous, downward facing surface for finishing the concrete over its entire length as the paving machine moves in the travel direction. All mating surfaces of the finishing pans, spacers, sideform and end frame are machined to ensure squareness and flatness to provide and maintain accurately fitted and dimensioned interfaces between these parts.

Figure 9:
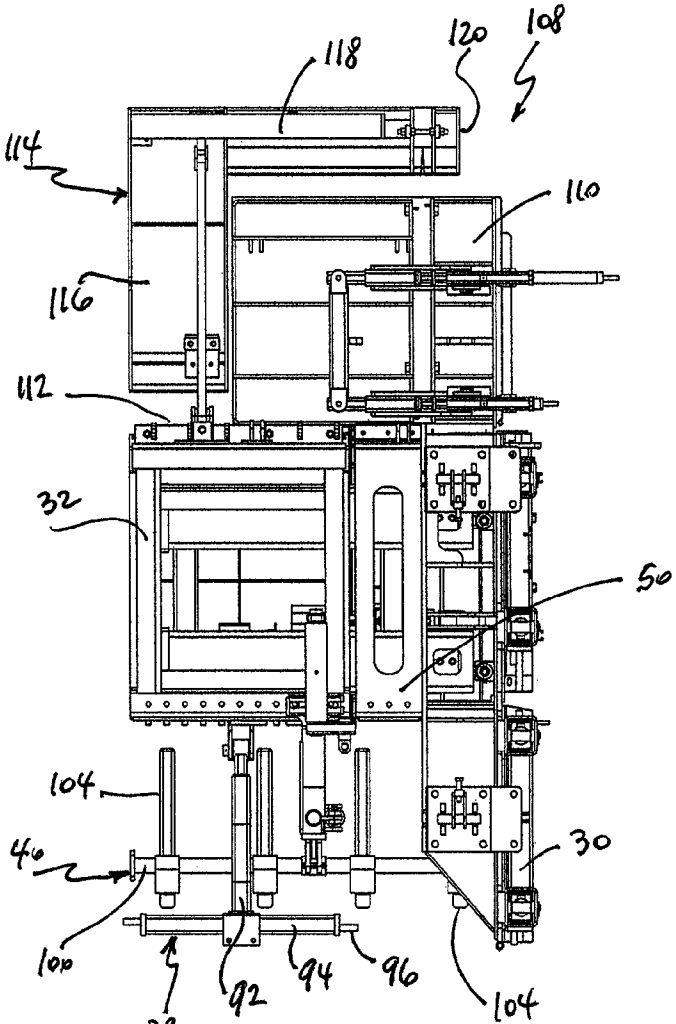
FIG. 9 is a view similar to FIG. 8 but illustrates the terminal kit in its shortest configuration and the resulting changes in the metering gate, the vibrator rack and the trailing leveling pans.
Figure 8:
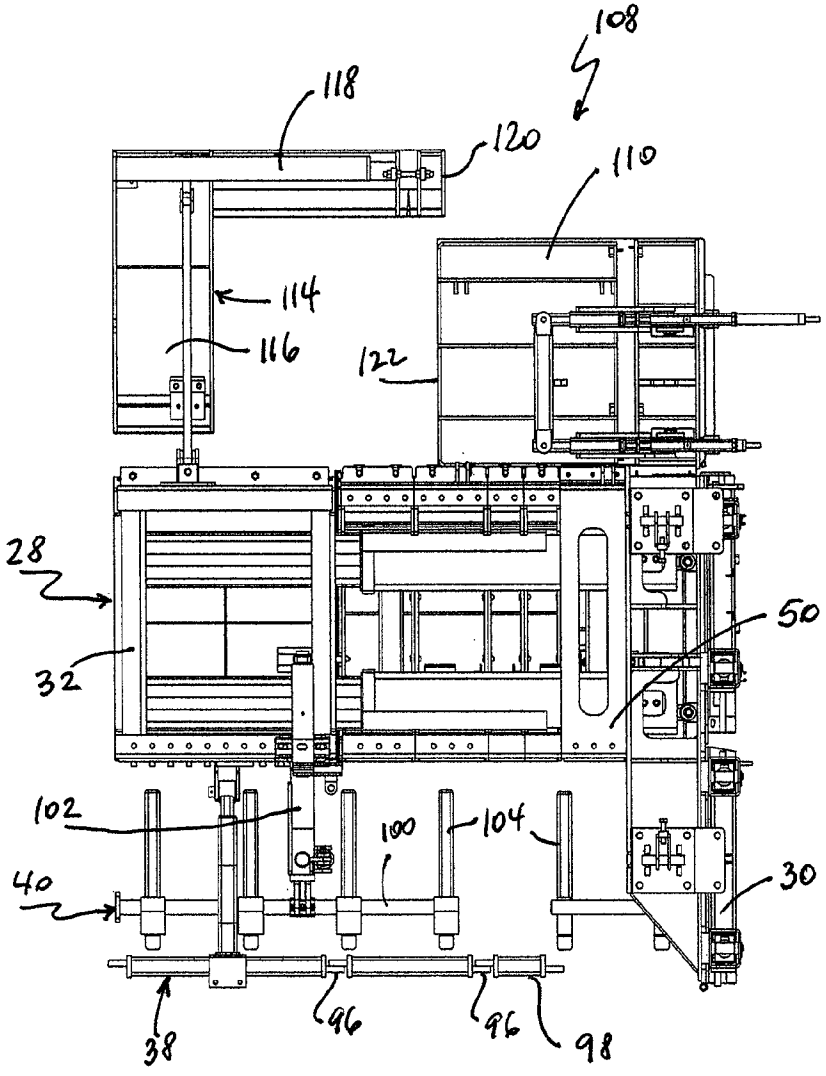
FIG. 8 is a plan view of the paving kit, including the terminal kit, showing the terminal kit in its extended position and illustrating the metering gate, the vibrator rack and the trailing leveling pan with overlapping sections to accommodate changes in the length of the terminal kit without having to change the trailing finishing pans.
Figure 10:
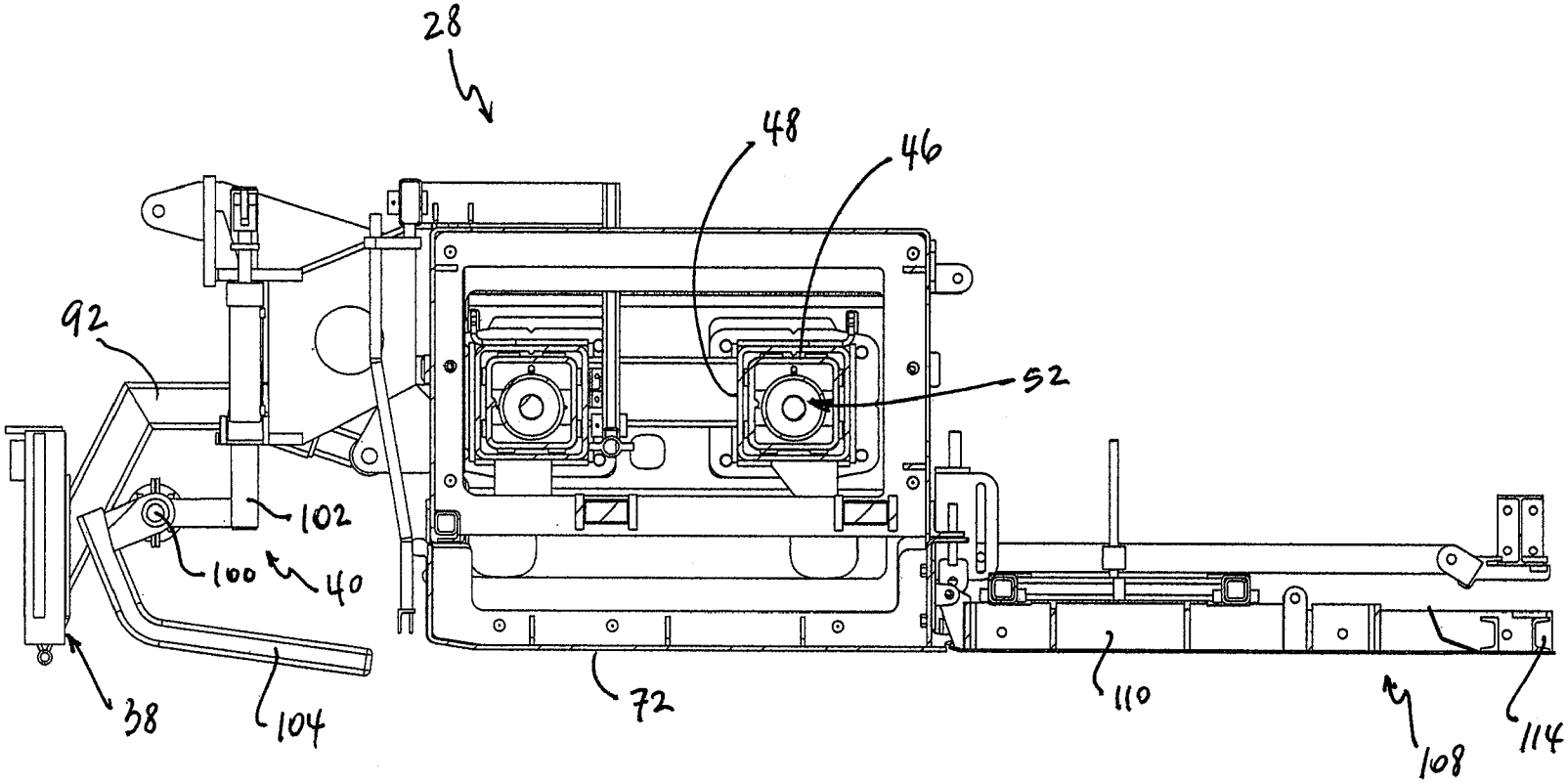
FIG. 10 is a side elevational view through the terminal kit and illustrates the hydraulic actuator which cooperates with male and female extension tubes for lengthening and shortening the terminal kit.

Referring to FIGS. 8-10 as earlier mentioned, metering gate 38 and vibrator rack 40 are arranged forward (in the travel direction 36) of paving kit 22.

The metering gate includes a frame 92 that extends forwardly from and over the entire length of paving kit 22. When the terminal kits are in their fully collapsed position (as shown in FIG. 9), an outermost metering gate plate 94 ends at some distance short of the slipform 30 as is conventional. Each metering gate includes a releasable connector 96 as is schematically shown in FIGS. 8 and 9 which keeps the adjacent plates in substantial alignment with each other and causes them to be raised and lowered via frame 92 in unison to set the lower edges of the plates at the desired concrete level prior to finishing.

When the terminal kit is lengthened, as shown in FIG. 8, an extension metering plate 98 is connected to the laterally outermost metering plate 94 (illustrated in FIG. 9, for example) via another connector 96. The length of the extension plate should approximately correspond to the length that was added to the terminal kit. In view thereof, it is preferred that each paving machine be provided with a number of extension metering plates 98 of varying lengths to accommodate anticipated length extensions of the metering gate for laying concrete strips 16 of varying widths. The width of the extension gates 92 is kept sufficiently small so that each plate is readily handled, lifted and installed by one person requiring no lifting assistance and only simple hand tools for connecting the plates.

Arranged between metering gate 38 and paving kit 22 is vibrator rack 40. It principally comprises an elongated bar 100 that extends over the length of the paving kit when it has its shortest length and is vertically adjustably secured to the paving kit 22 via spaced-apart mounting assemblies 102. Conventional, slightly curved and rearwardly inclined high frequency vibrators 104 are attached to the vibrator bar 100 at regular intervals. The vibrator bar has a length so that its ends, and the laterally outermost vibrators 100, are relatively close to slipforms 30 at either end of the paving kit as seen in FIG. 9.

For lengthening terminal kit 22, and to assure that the freshly placed concrete is vibrated over the full width of the concrete strip being laid, a relatively short vibrator bar extension 106 is suitably secured, e.g. bolted, to sideform 30 and from there extends in an inward direction as illustrated in FIG. 8 that is spaced apart from the end of vibrator bar 100 and positioned so that when no vibrators are mounted on vibrator bar extension 106, the extension overlaps the end of vibrator bar 100. One or more vibrators 104 are mounted on extension bar 106, depending on the length of the bar. For greater widths of the paving kit, the length of vibrator bar extension 106 is increased to provide space for additional vibrators that may be required.

To facilitate the rapid changeover of the terminal kit from one length to another, each machine is preferably provided with a number of vibrator bar extensions 106 to accommodate all possible extensions of the length of the terminal kit and the required number of vibrators. Thus, modifying the vibrator rack to accommodate different widths of the terminal rack requires no disturbance of the existing and permanently installed vibrator rack. Instead, all that is needed are short lengths of pipe, preferably fitted with suitable mounting flanges (not shown in the drawings) which can be rapidly bolted onto the sideform and connected to the needed hydraulic pressure lines, which is quickly done by one person with no more than simple hand tools.

Still referring to FIGS. 8-10, a trailing finishing pan 108 is mounted on the aft side of terminal kit 28 for finishing portions of the concrete surface 18 close to the sides of the concrete slab. To assure that the trailing finishing pan finishes the entire width of the concrete strip, whether it is narrow (when the terminal kit is collapsed) or wide (when the terminal kit is extended), a first outermost trailing finishing pan section 110 is secured to the aft side 112 of the terminal kit 28.

The outermost finishing pan 110 may have an underside which contacts the fresh concrete during paving which is flat. Optionally, the outermost finishing pan may be contoured to provide an edge overbuild along the side wall 20 of the concrete strip 16 being laid down, for example when the concrete mix has a relatively high slump, as is well known to those skilled in the art. Alternatively, outermost finishing pan section 110 may be contoured (not shown) to form gutters, curbs and the like along the edge of the concrete strip being laid down, as is also well known to those of ordinary skill in the art.

An additional, generally L-shaped inner trailing finishing pan 114 is secured to the end of the floating trailing finishing pan center section. The inner finishing pan has a rearwardly oriented extension 116 of a length greater than the length in the aft direction of outer finishing pan section 110. A second, laterally extending portion 118 of the inner finishing pan has a sufficient length so that, when the terminal kit is at its maximum length, the free end 120 of outboard extension 118 overlaps the inboard end 122 of outer finishing pan 110, as can be seen in FIG. 8. Additional trailing finishing pans are arranged over the remaining length of the paving kit but are not further described herein because they are conventional and do not affect the present invention.

The paving machine can be provided with a pivotal connection 23 as seen in FIGS. 2 and 3 at the center of the paving machine. Its pivot axis is parallel to the travel direction. The pivotal connection permits raising and lowering a midsection of the paving kit relative to lateral ends thereof for forming crowns in the upwardly exposed surface of the concrete.

What is claimed is:

1. A paving kit for a paving machine moving in a travel direction for spreading, leveling and finishing concrete into a form having a generally upwardly exposed, finished concrete surface and terminating in lateral sides, the paving kit comprising a substantially rigid center portion oriented substantially perpendicular to the travel direction terminating in lateral ends, and a variable length terminal paving kit secured to each lateral end of the center portion, each terminal paving kit comprising an end frame configured to be secured to a respective one of the lateral ends of the center portion, including at least one male support tube fixed to the end frame and extending laterally away from the center portion, a sideform including at least one female support tube fixed to the sideform, arranged to telescopingly receive the male support tube therein, and permitting relative movement of the tubes and of the end frame and the sideform laterally towards and away from each other, a hydraulic actuator having a cylinder and a piston section arranged inside the cylinder, the cylinder and the piston section having respective ends operatively connected to the end frame and the sideform so that activation of the actuator moves the end frame and the sideform relative to each other as guided by the tubes, a plurality of upright spacers removably attached to the female tube at front and aft sides of the terminal paving kit relative to the travel direction, cooperating pairs of spacers being aligned in the travel direction, and a finishing pan for finishing a portion of the concrete surface removably attached to lower ends of the cooperating pairs of upright spacers, the end frame, the spacers, the pans and the sideform being compressed against each other following actuation of the hydraulic actuator of each terminal kit to thereby form rigid terminal kits, and at least some of the weight of the spacers, the pans and the sideform being supported by the male and female support tubes when the hydraulic actuator does not compress the sideform against the end frame.

2. A paving kit for a paving machine according to claim 1 including an additional plurality of cooperating pairs of upright spacers and associated finishing pans, at least some of the additional plurality of upright spacers and associated finishing pans having a length in the lateral direction which is different from the lengths of at least some of the first-mentioned plurality of upright spacers and associated finishing pans.

3. A paving kit for a paving machine according to claim 2 including an adjustment mechanism between lower ends of the upright spacers and ends of the associated finishing pans on the aft side of the terminal kit adapted to move at least an aft portion of the finishing pan in a generally vertical direction relative to the spacer for accurately aligning at least the aft portions of the finishing pan relative to the other finishing pans of the terminal kit for paving a continuous, smooth upper concrete surface.

4. A paving kit for a paving machine according to claim 3 wherein the adjustment mechanism comprises an adjustment screw and nut arrangement connected to an aft side of one of the spacer and the associated finishing pan which is movable relative thereto for engaging and disengaging an adjacent portion of the other one of the spacer and the finishing pan, the screw and nut arrangement being adapted to raise or lower the finishing pan relative to the associated spacer.

5. A paving kit for a paving machine according to claim 1 wherein the at least one female support tube includes first and second ledges adjacent forwardmost and aftmost portions of the at least one female tube, and wherein the spacers include hooks engaging the ledges for substantially vertically hanging the spacers from the at least one female tube.

6. A paving kit for a paving machine according to claim 5 wherein the ledges are arranged proximate an uppermost portion of the at least one female tube, and including a further set of ledges arranged below the at least one female tube and extending parallel to the first-mentioned ledges, and wherein the spacers include second hooks engaging the second ledges when the spacers are substantially vertical.

7. A paving kit for a paving machine according to claim 6 wherein the lower ends of the spacers of each pair of cooperating opposite spacers and forward and aft ends of the finishing pans define a slip joint connecting the lower ends of the cooperating spacers and the aft and forward ends of the associated finishing pans to each other.

8. A paving kit for a paving machine according to claim 7 wherein the slip joint connection is defined by a gap formed in one of the lower ends of the spacers and the aft and forward ends of the cooperating finishing pan and a flange insertable into the gap and connected to the other one of the lower ends of the spacers and the associated aft and forward ends of the cooperating finishing pan.

9. A paving kit according to claim 1 wherein the end frame and the sideform include a pair of parallel male support tubes and female support tubes, respectively.

10. A paving kit for a paving machine according to claim 1 wherein surfaces of the end frame, the slipform, the spacers and the finishing pans facing in lateral directions are machined surfaces forming a tight fit between them that prevents the passage of fresh concrete past them.

11. A paving kit for a paving machine according to claim 10 including a plurality of alignment pins between the laterally opposing, machined surfaces of the end frame, the sideform, the upright spacers and the finishing pans keeping the end frame, the sideform, the upright spacers and the finishing pans in mutual alignment.

12. A paving kit for a paving machine according to claim 1 wherein non-overlapping ends of the male and female support tubes include a flange secured to laterally facing surfaces of the end frame and the sideform, respectively.

13. A paving kit for a paving machine according to claim 1 wherein the spacing between opposing lateral end surfaces of the end frame and the slipform can be varied over a range of between zero and about three feet.

14. A paving kit for a paving machine according to claim 1 wherein the paving machine includes a metering gate located forward of the paving kit in the travel direction, and including metering gate extension sections adapted to be secured to lateral ends of the metering gate for changing a lateral length of the metering gate to correspond to the lateral length between opposing surfaces of the slipforms of the paving kit.

15. A paving kit for a paving machine according to claim 14 including a connector releasably securing the metering gate extensions to the lateral ends of the metering gate.

16. A paving kit for a paving machine according to claim 1 wherein the paving machine includes a vibrator rack located forward of the paving kit in the travel direction, the vibrator rack comprising a transversely extending support bar and a multiplicity of vibrators extending from the support bar into the concrete being formed, and further including at least one vibrator bar extension adapted to be connected to the slipform in substantial alignment with the vibrator rack for adjusting the length of the vibrator bar to correspond to the spacing between opposing sides of the sideforms.

17. A paving kit for a paving machine according to claim 16 wherein opposing ends of the vibrator bar and the vibrator bar extension are spaced apart, and including at least one vibrator attached to the vibrator bar extension.

18. A paving kit for a paving machine according to claim 1 including a trailing finishing pan extending from a proximate sideform towards the opposite sideform and located on an aft side of the paving kit, and a trailing finishing pan overlap section secured to the end frame projecting rearwardly of the trailing finishing pan and laterally towards the sideform from which the finishing pan projects for finishing the concrete surface without the need for changing trailing finishing pans irrespective of the length of the terminal paving kit in the lateral direction.

19. A paving kit for a paving machine according to claim 18 wherein the trailing finishing pan and the overlap section are movable relative to each other in the lateral direction.

20. A paving kit for a paving machine according to claim 1 including an outermost finishing pan which has, as seen in the travel direction, a lowermost, concrete finishing surface that is one of a flat surface, a sloped surface, an edge overbuild or a curb profile proximate the adjoining lateral side of the concrete for giving the concrete surface adjacent the lateral side of the concrete a correspondingly shaped profile.

21. A paving machine moving in a travel direction for spreading, leveling and finishing concrete into a form having a generally upwardly exposed, finished concrete surface and terminating in lateral sides, the paving machine comprising a main tractor frame including first and second bolsters arranged at opposite ends of the main frame and including crawlers engaging the ground for moving the paving machine in the travel direction, and a paving kit secured to the machine frame and including a substantially rigid center portion oriented substantially perpendicular to the travel direction, terminating in lateral ends, and disposed between the bolsters, and a variable length terminal paving kit secured to each lateral end of the center portion, each terminal kit being defined by an end frame secured to the center portion, a sideform defining a lateral end of the paving kit, and an adjustable length support structure between the end frame and the sideform, the support structure including a hydraulic piston having operative ends connected to the end frame and the sideform, respectively, for moving the end frame and the sideform towards and away from each other, a plurality of spacers interposed between the end frame and the sideform a combined width of which defines the spacing between the end frame and the sideform and therewith a distance between the lateral sides of the concrete, a finishing pan between opposing pairs of spacers for finishing the concrete surface, and the hydraulic piston operatively coupled to the end frame and the sideform applying a compressive force to the spacers and the finishing pans to thereby rigidly connect the end frame to the sideform with the spacers and the finishing pans between them, the paving machine further including an additional plurality of spacers of differing widths in the lateral direction to enable changing the distance between the lateral sides of the concrete by relieving the pressure applied by the hydraulic actuator against the spacers and the finishing pans between the end frame and the sideform, substituting different spacers and finishing pans for the ones previously disposed between the end frame and the sideform to provide a desired, different length of the terminal paving kit, and thereafter reapplying pressure with the hydraulic actuator against the substituted spacers and finishing pans between the end frame and the terminal kit, the paving machine further including a metering gate forward of the paving kit in the travel direction for leveling freshly supplied concrete, a vibrator arrangement disposed between the metering gate and the paving kit for temporarily liquefying the applied concrete prior to finishing its upwardly exposed surface, and a trailing finishing pan located on an aft side of the paving kit for finishing the upwardly exposed concrete surface adjacent the lateral sides of the concrete.

22. A paving machine according to claim 21 wherein the spacers are arranged between the end frame and the sideform and include hooks for engaging laterally extending ledges between the end frame and the sideform from which the spacers are gravitationally hung, wherein the finishing pan comprises a plurality of finishing pan sections each having a width in the lateral direction corresponding to the lateral width of opposing pairs of spacers, and including a tongue and groove connection between lower ends of the opposing spacers and respective ends of the finishing pans.

23. A paving machine according to claim 21 including a pivotal connection at a center of the paving machine having a pivot axis parallel to the travel direction permitting raising and lowering a midsection of the paving kit relative to lateral ends thereof for forming crowns in the upwardly exposed surface of the concrete.

* * * * *